US010990046B2

(12) United States Patent
Watatani et al.

(10) Patent No.: US 10,990,046 B2
(45) Date of Patent: Apr. 27, 2021

(54) FIXING DEVICE HAVING HEATER HOLDING MEMBER WITH INCLINED SLITS

(71) Applicant: KYOCERA Document Solutions Inc., Osaka (JP)

(72) Inventors: Tomohiro Watatani, Osaka (JP); Masakazu Uehara, Osaka (JP); Hironori Takahashi, Osaka (JP); Yuhiro Sakai, Osaka (JP); Fumito Nakamoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/887,270

(22) Filed: May 29, 2020

(65) Prior Publication Data

US 2020/0379386 A1 Dec. 3, 2020

(30) Foreign Application Priority Data

May 31, 2019 (JP) ..... JP2019-102278

(51) Int. Cl.
*G03G 15/20* (2006.01)

(52) U.S. Cl.
CPC ..... *G03G 15/2053* (2013.01); *G03G 15/2017* (2013.01); *G03G 15/2064* (2013.01); *G03G 15/2025* (2013.01); *G03G 2215/2035* (2013.01)

(58) Field of Classification Search
CPC ..... G03G 15/2053; G03G 15/2064; G03G 2215/2035; G03G 15/2017; G03G 15/2025
See application file for complete search history.

(56) References Cited

U.S. PATENT DOCUMENTS 7,805,102 B2 * 9/2010 Kato ..... G03G 15/2025 399/329
2001/0019676 A1 * 9/2001 Okubo ..... G03G 15/2064 399/328
2007/0231026 A1 * 10/2007 Hayashi ..... G03G 15/2025 399/329
2017/0219969 A1 * 8/2017 Umeda ..... G03G 15/2039
(Continued)

FOREIGN PATENT DOCUMENTS

JP 2016212215 A * 12/2016
JP 2017-116572 A 6/2017

*Primary Examiner* — Walter L Lindsey, Jr.
*Assistant Examiner* — Laura Roth
(74) *Attorney, Agent, or Firm* — Studebaker & Brackett PC

(57) ABSTRACT

A fixing device includes a fixing belt, a pressure member, and a heating section. The heating section faces an inner circumferential surface of the fixing belt. The heating section includes a heater and a heater holding member. The heater heats the fixing belt. The heater holding member holds the heater. The heater holding member has a first side surface, a second side surface, and an inclined slit. The first and second side surfaces are in contact with the inner circumferential surface. The first side surface has the inclined slit. The inclined slit is located in the first side surface in a direction of a rotational axis of the fixing belt. The inclined slit has one end on a side of the pressure member and the other end on an opposite side to the side of the pressure member. The other end is located nearer a middle (center) of the first side surface in the direction of the rotational axis than the one end.

4 Claims, 11 Drawing Sheets

(56) References Cited

U.S. PATENT DOCUMENTS

| | | | | |
|---|---|---|---|---|
| 2018/0011434 | A1* | 1/2018 | Adachi | G03G 15/2025 |
| 2018/0203384 | A1* | 7/2018 | Okamoto | G03G 15/2053 |
| 2019/0346795 | A1* | 11/2019 | Morimoto | G03G 15/2025 |

* cited by examiner

FIXING DEVICE HAVING HEATER HOLDING MEMBER WITH INCLINED SLITS

INCORPORATION BY REFERENCE

The present application claims priority under 35 U.S.C. § 119 to Japanese Patent Application No. 2019-102278, filed on May 31, 2019. The contents of this application are incorporated herein by reference in their entirety.

BACKGROUND

The present disclosure relates to a fixing device and an image forming apparatus.

An electrographic image forming apparatus includes a fixing device that fixes a toner image to paper. A fixing device includes a belt, a pressure member, a heat source, a nip forming member, and a heat transfer auxiliary member.

The belt is flexible and has an endless shape. The pressure member faces the belt and passively rotates the belt. The heat source is placed in an inner part of the belt. The nip forming member is placed inside the belt and forms a fixing nip between the belt and the pressure member. The heat transfer auxiliary member covers a surface of the nip forming member facing the belt.

When the belt is rotated by the pressure member, the belt and the nip forming member are rubbed. The belt and the nip forming member are rubbed, thereby generating friction powder. The friction powder mixes with a lubricating oil. The lubricating oil adheres to an inner circumferential surface of the belt. The lubricating oil reduces friction between the belt and the nip forming member. When the friction powder mixes with the lubricating oil, viscosity of the lubricating oil increases. When the viscosity of the lubricating oil increases, lubrication performance of the lubricating oil decreases. When the performance of the lubricating oil decreases, the friction between the belt and the nip forming member increases. Such an increase in the friction between the belt and the nip forming member causes an increase in torque for rotating the belt.

With a second lubricating oil placed inside the belt, the fixing device drops the second lubricating oil on the inner circumferential surface of the belt. The fixing device adds the lubricating oil on the inner circumferential surface of the belt, thereby preventing an increase in viscosity of the lubricating oil and an increase in torque for rotating the belt.

SUMMARY

A fixing device according to an aspect of the present disclosure includes a fixing belt, a pressure member, and a heating section. The pressure member rotates the fixing belt while applying pressure to an outer circumferential surface of the fixing belt. The heating section faces an inner circumferential surface of the fixing belt. The heating section includes a heater and a heater holding member. The heater heats the fixing belt. The heater holding member holds the heater. The heater holding member includes a first side surface, a second side surface, and an inclined slit. The first and second side surfaces are in contact with the inner circumferential surface. The inclined slit is located in at least one of the first and second side surfaces in a direction of a rotational axis of the fixing belt. The inclined slit has one end on a side of the pressure member and an other end on an opposite side to the side of the pressure member. The other end is located nearer a middle of the fixing belt in the direction of the rotational axis than the one end.

An image forming apparatus according to an aspect of the present disclosure includes the above-described fixing device and an image forming section. The image forming section forms a toner image on a recording medium. The fixing device fixes the toner image to the recording medium.

DETAILED DESCRIPTION

First Embodiment

Figure 1:
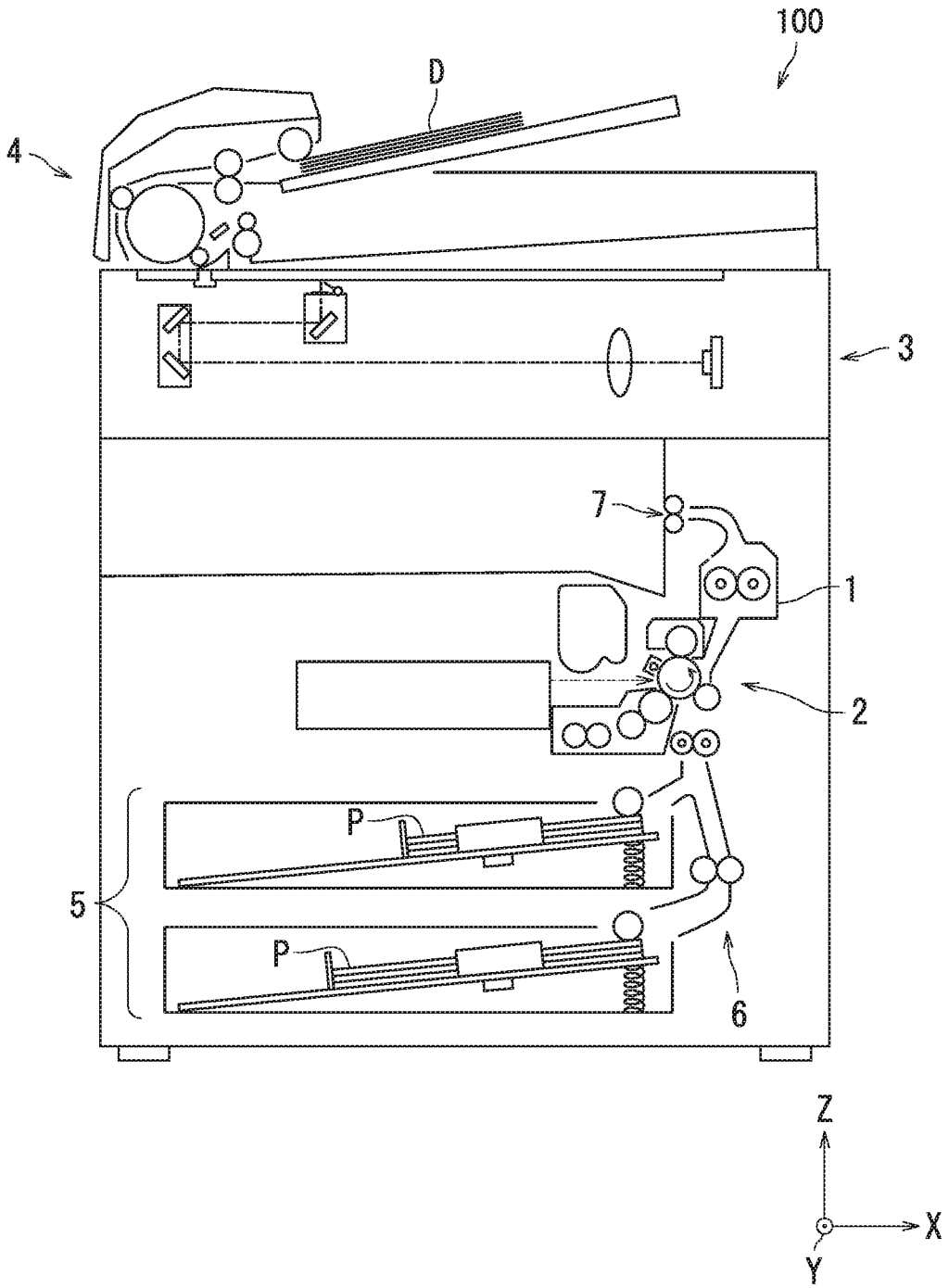
FIG. 1 illustrates an image forming apparatus according to a first embodiment of the present disclosure.

A first embodiment according to the present disclosure will hereinafter be described with reference to the accompanying drawings. Elements that are the same or equivalent are labelled with the same reference signs in the drawings and description thereof is not repeated. In the first embodiment, mutually perpendicular X, Y, and Z axes are depicted in the drawings. The Z axis is parallel to a vertical plane, while the X and Y axes are parallel to a horizontal plane.

An image forming apparatus 100 according to the first embodiment of the present disclosure will be described with reference to FIG. 1. FIG. 1 illustrates the image forming apparatus 100 according to the first embodiment of the present disclosure. Examples of the image forming apparatus 100 include a copier, a facsimile machine, and a multifunction peripheral with those functions. The image forming apparatus 100 according to the first embodiment is a monochrome multifunction peripheral.

As illustrated in FIG. 1, the image forming apparatus 100 includes a fixing device 1, an image forming section 2, a reading section 3, a document conveyance section 4, a paper feed section 5, a conveyance section 6, and an ejection section 7.

The reading section 3 reads an image of a document D. The reading section 3 generates image data from the read image. The document conveyance section 4 conveys the document D to the reading section 3. The paper feed section 5 accommodates sheets of paper P and feeds the paper P to the conveyance section 6 one piece at a time. The paper P is one example of a recording medium. For example, the recording medium is made from synthetic resin or paper. The conveyance section 6 includes conveyance roller pairs and conveys the paper P to the ejection section 7 via the image forming section 2.

The image forming section 2 electrographically forms a toner image on the paper P based on the image data. The image data represents for example an image of the document D. The image forming section 2 includes for example an electro-photosensitive drum, a charger, a light exposure device, a development device, a replenishment device, a transfer roller, a cleaner, and a static eliminator.

The fixing device 1 applies heat and pressure to the toner image to fix the toner image to the paper P. The conveyance section 6 conveys, to the ejection section 7, the paper P to which the toner image has been fixed. The ejection section 7 ejects the paper P out of a housing of the image forming apparatus 100.

Figure 2:
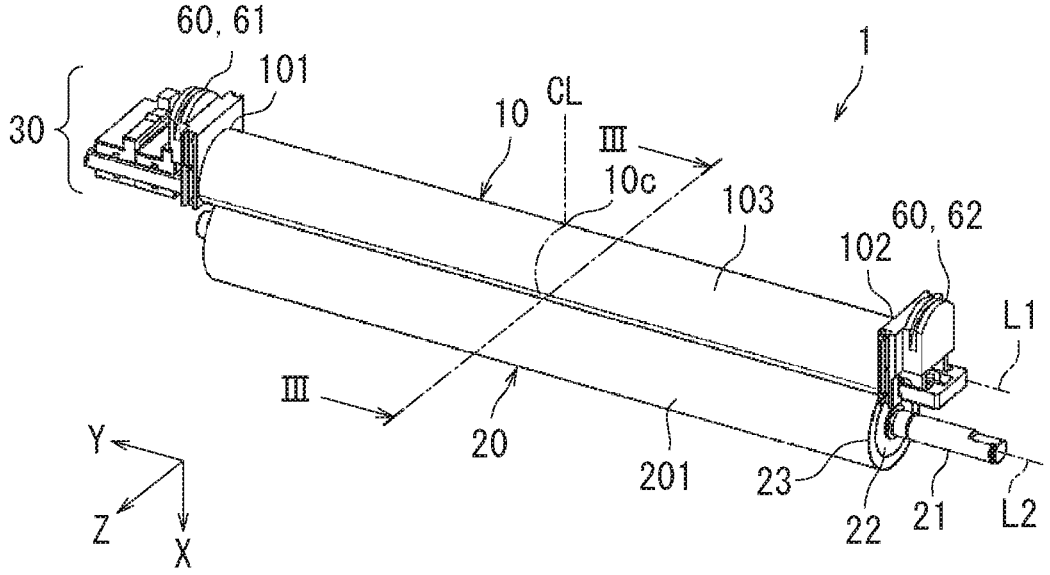
FIG. 2 is a perspective view of main parts of a fixing device of the image forming apparatus according to the first embodiment of the present disclosure.

A configuration of the fixing device 1 according to the first embodiment will next be described in detail with reference to FIGS. 2 and 3. FIG. 2 is a perspective view of main parts of the fixing device 1 according to the first embodiment.

As illustrated in FIG. 2, the fixing device 1 includes a fixing belt 10, a pressure member 20, a heating section 30, and a belt holding member 60.

The fixing belt 10 heats the paper P to which the toner image has been transferred. The fixing belt 10 has an endless shape. The fixing belt 10 is substantially hollow cylindrical in shape. The fixing belt 10 is flexible. The fixing belt 10 is allowed to rotate around a first rotational axis L1 as an axial center. The fixing belt 10 extends in a direction of the first rotational axis L1. The fixing belt 10 includes a first end 101, a second end 102, and an outer circumferential surface 103. The first and second ends 101 and 102 are opposite ends of the fixing belt 10 in the direction of the first rotational axis L1. The direction of the first rotational axis L1 may hereinafter be referred to as a "rotational axis direction", a "rotational axis direction of the fixing belt 10", or a "width direction of the fixing belt 10". In addition, a middle (center) 10*c* of the fixing belt 10 in the rotational axis direction may be referred to as a "middle 10*c* of the belt". The middle 10*c* may be referred to as the "center 10*c*". Moreover, an imaginary line crossing the middle 10*c* of the belt is referred to as a middle line CL. The middle line CL may be referred to as a "center line CL".

The fixing belt 10 includes layers. The fixing belt 10 includes for example a polyimide layer and a releasing layer 23. The releasing layer 23 is formed on an outer circumferential surface of the polyimide layer. The releasing layer 23 is for example a heat resistant film made from fluororesin.

The pressure member 20 applies pressure to the outer circumferential surface 103 of the fixing belt 10, and also rotates the fixing belt 10. The pressure member 20, together with the fixing belt 10, applies pressure to the paper P to which the toner image has been transferred. Specifically, the pressure member 20 is substantially columnar in shape and placed facing the fixing belt 10. The pressure member 20 has an outer circumferential surface 201. The pressure member 20 presses the fixing belt 10. This causes the outer circumferential surface 201 of the pressure member 20 to be in contact with the outer circumferential surface 103 of the fixing belt 10, thereby forming a fixing nip.

The pressure member 20 is allowed to rotate on a second rotational axis L2. While the pressure member 20 is rotating, the fixing belt 10 rotates following the pressure member 20 being rotating. In other words, the pressure member 20 rotates the fixing belt 10. In the configuration, the toner image is fixed to the paper P as a result of the paper P passing through the fixing nip. Note that the paper P is conveyed in a paper conveyance direction (to a positive side of the Z axis). The pressure member 20 is for example a pressure roller. The pressure member 20 extends along the second rotational axis L2. Note that the second rotational axis L2 is substantially parallel to the first rotational axis L1.

The pressure member 20 includes a metal core 21 that is columnar, an elastic layer 22 that is hollow cylindrical, and a releasing layer 23. The elastic layer 22 is formed on the metal core 21. The releasing layer 23 is formed to cover a surface of the elastic layer 22. The metal core 21 is allowed to rotate on the second rotational axis L2. The metal core 21 is made from for example stainless steel or aluminum. The elastic layer 22 has elasticity and is made from for example silicone rubber. The releasing layer 23 is made from for example fluororesin.

The belt holding member 60 holds the ends of the fixing belt 10. The belt holding member 60 includes a first holding member 61 and a second holding member 62. The first holding member 61 holds the first end 101 of the fixing belt 10. The second holding member 62 holds the second end 102 of the fixing belt 10.

Figure 3:
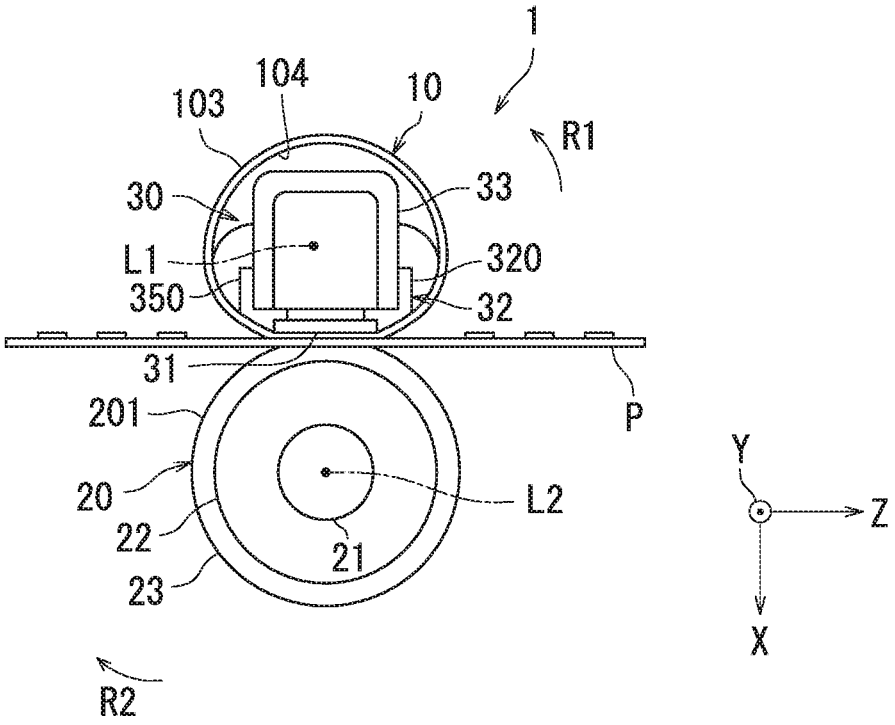
FIG. 3 is a cross-sectional view of the fixing device taken along a line III-III of FIG. 2.

FIG. 3 is a sectional view of the fixing device 1 taken along a line III-III of FIG. 2. Note that the belt holding member 60 and part of elements inside the fixing belt 10 are omitted in FIG. 3 for easy understanding.

As illustrated in FIG. 3, the fixing belt 10 further has an inner circumferential surface 104. The inner circumferential surface 104 of the fixing belt 10 faces the heating section 30. In other words, the heating section 30 is placed inside the fixing belt 10, and faces the inner circumferential surface 104 of the fixing belt 10. The heating section 30 includes a heater 31, a heater holding member 32, and a reinforcing member 33.

The heater 31 heats the fixing belt 10. The heater 31 extends along the first rotational axis L1. Examples of the heater 31 include a surface heater and a long thin plate heater. The heater 31 is for example a ceramic heater and includes a ceramic substrate and a resistance heating element. The heater 31 is for example 1 mm in thickness. The heater 31 receives pressure from the pressure member 20 through the fixing belt 10. The heater 31 receives pressure from the reinforcing member 33 through the heater holding member 32.

The heater holding member 32 holds the heater 31. The heater holding member 32 and the fixing belt 10 are located on opposite sides of the heater 31. The heater holding member 32 is placed inside the fixing belt 10 on the side nearer the pressure member 20 than the first rotational axis L1. The heater holding member 32 is for example made from heat resistant resin. The heater holding member 32 extends along the first rotational axis L1. One of two ends of the heater holding member 32 in the direction of the first rotational axis L1 is allowed to engage with for example a connector located at a main body of the image forming apparatus 100.

The heater holding member 32 has a first side surface 320 and a second side surface 350. The first side surface 320 is a side surface of the heater holding member 32 on the positive side of the Z axis. The second side surface 350 is a side surface of the heater holding member 32 on a negative side of the Z axis. Part of the inner circumferential surface 104 is in contact with the first and second side surfaces 320 and 350. The part of the inner circumferential surface 104 is contact with part or all of the first and second side surfaces 320 and 350.

The reinforcing member 33 reinforces the heater holding member 32. The reinforcing member 33 is for example a long thin metal frame stay member. The reinforcing member 33 has a substantially inverted U-shape in a sectional view in a direction along the first rotational axis L1. The reinforcing member 33 extends along the first rotational axis L1. The reinforcing member 33 faces the heater holding member 32. The reinforcing member 33 and the heater 31 are located on opposite sides of the heater holding member 32. The heater holding member 32 is supported by the belt holding member 60.

The fixing belt 10 rotates in a first rotational direction R1, following the pressure member 20 rotating in a second rotational direction R2. Therefore, of the inner circumferential surface 104 of the fixing belt 10, part facing the first side surface 320 of the heater holding member 32 moves to a negative side of the X axis. In contrast, of the inner circumferential surface 104 of the fixing belt 10, part facing the second side surface 350 of the heater holding member 32 moves to a positive side of the X axis.

Lubricating oil G is applied to an inside of the fixing belt 10. The lubricating oil G moves following the fixing belt 10 being rotating. Specifically, when the fixing belt 10 rotates in the first rotational direction R1, part of the lubricating oil G that is out of contact with the first and second side surfaces 320 and 350 moves toward the first or second end 101 or 102 described with reference to FIG. 2.

Figure 4:
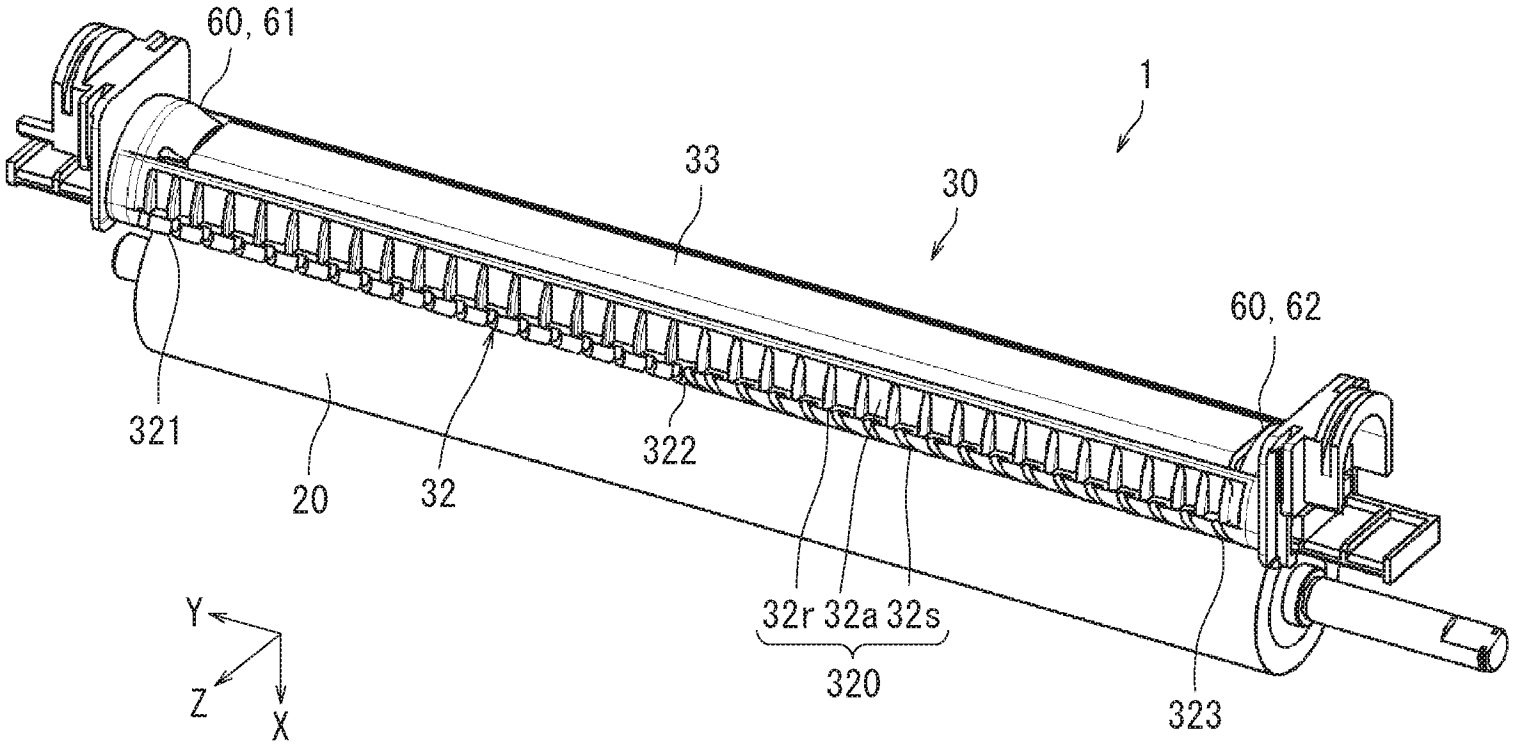
FIG. 4 is a perspective view of the fixing device depicted in FIG. 2 with a fixing belt thereof omitted.

Next, the configuration of the heater holding member 32 in the first embodiment will further be described with reference to FIGS. 4 to 6. FIG. 4 is a perspective view of the fixing device 1 depicted in FIG. 2 with the fixing belt 10 omitted.

As illustrated in FIG. 4, the first side surface 320 has a first end 321, a middle 322, and a second end 323. The middle 322 may hereinafter be referred to as a "center 322". The first and second ends 321 and 323 of the heater holding member 32 are opposite ends of the heater holding member 32 in a width direction thereof. The width direction of the heater holding member 32 corresponds to a Y-axis direction. The middle 322 is a middle (center) of the heater holding member 32 in the width direction thereof. The middle 322 is located on the middle line CL described with reference to FIG. 2. The first holding member 61 engages with the first end 321 of the heater holding member 32. The second holding member 62 engages with the second end 323 of the heater holding member 32.

The heater holding member 32 has a main body 32*a*, and also has ribs 32*r* and inclined slits 32*s* on a side of the first side surface 320. The present disclosure is not limited to the inclined slits 32*s*. This may be applied to the whole present disclosure. The ribs 32*r* are arranged at regular intervals in the Y-axis direction. The ribs 32*r* are not necessarily arranged at regular intervals. The Y-axis direction is the rotational axis direction (direction perpendicular to the rotational direction) of the fixing belt 10. The ribs 32*r* protrude from the main body 32*a*. The inclined slits 32*s* are recessed in the main body 32*a*.

The inclined slits 32*s* will next be described with reference to FIGS. 3, 5, and 6. FIG. 5 is a view of the fixing device 1 depicted in FIG. 4, as seen from the positive side of the Z axis. Specifically, FIG. 5 is a view of the fixing device 1 as seen from the side of the first side surface 320 of the heater holding member 32.

Figure 5:
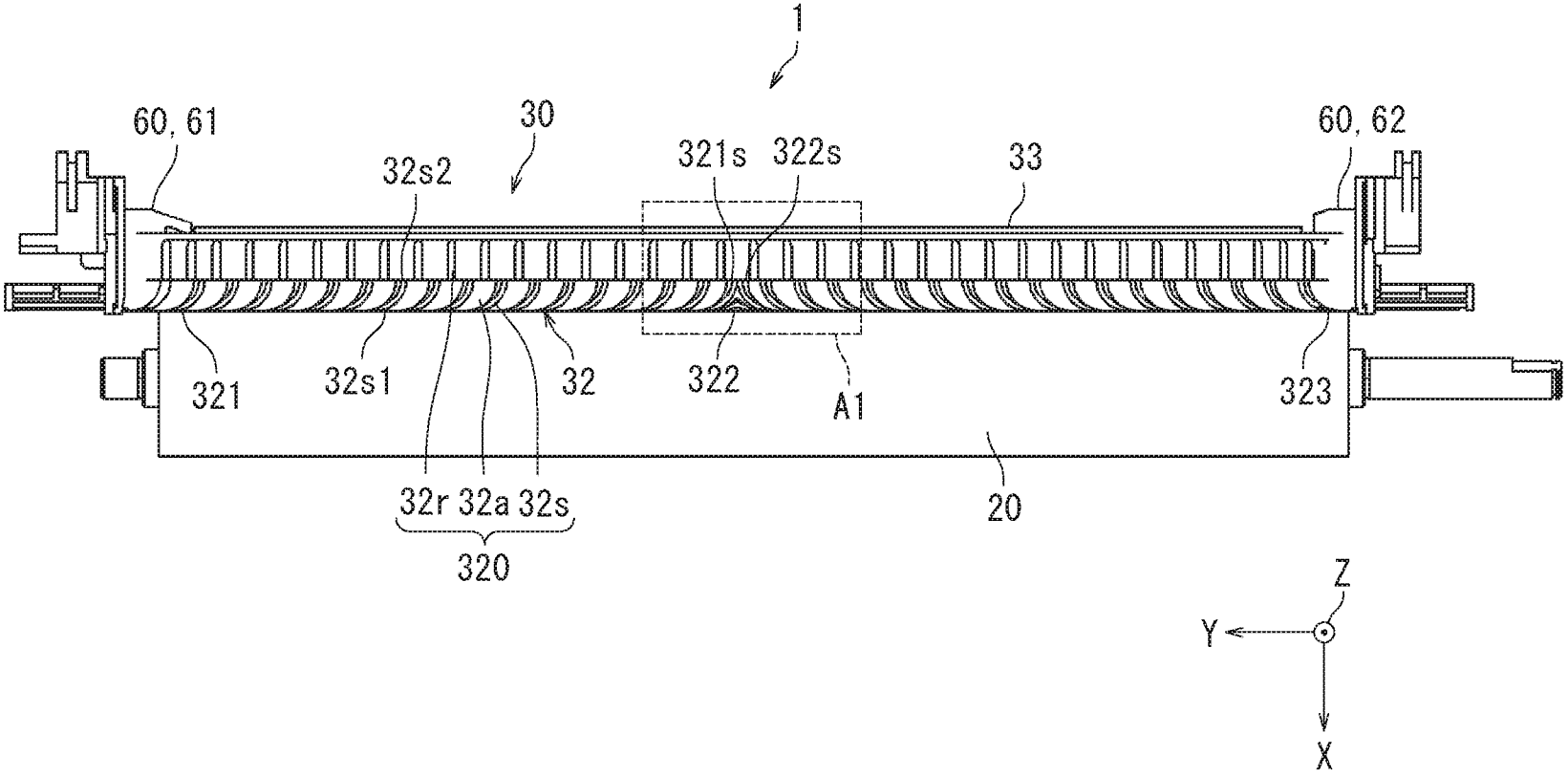
FIG. 5 illustrates the fixing device depicted in FIG. 4, as seen from a positive side of a Z axis.

As illustrated in FIG. 5, the inclined slits 32*s* are arranged in the direction of the first rotational axis L1 (direction perpendicular to the rotational direction) of the fixing belt 10. The inclined slits 32*s* are arranged in a symmetrical manner about the middle 322 of the heater holding member 32. Specifically, the inclined slits 32*s* are arranged in a line symmetrical manner about the middle line CL crossing the middle 10*c* of the fixing belt 10 (see FIG. 2).

The inclined slits 32*s* are arranged at regular intervals in the rotational axis direction (direction perpendicular to the rotational direction) of the fixing belt 10. The inclined slits 32*s* are not necessarily arranged at regular intervals. This may be applied to the whole present disclosure. The inclined slits 32*s* may be arranged in a symmetrical manner about the middle 322 of the heater holding member 32. Specifically, the inclined slits 32*s* may be arranged in a line symmetrical manner about the middle line CL crossing the middle 10*c* of the fixing belt 10 (see FIG. 2).

Inclined slits 32*s* located nearer the first end 321 than the middle 322 may hereinafter be referred to as a "first slit group". In addition, inclined slits 32*s* located nearer the second end 323 than the middle 322 may hereinafter be referred to as a "second slit group".

The heater holding member 32 has inclined slits 32*s*, or a first or second confluent slit 321*s* or 322*s* on the side of the first side surface 320. The first slit group includes the first confluent slit 321*s*. The second slit group includes the second confluent slit 322*s*. In the first embodiment, the first confluent slit 321*s* includes two inclined slits 32*s*. In addition, the second confluent slit 322*s* includes two inclined slits 32*s*.

The inclined slit 32*s* has one end 32*s*1 and the other end 32*s*2. That is, each of the inclined slits 32*s* has one end 32*s*1 and the other end 32*s*2. The one end 32*s*1 is located on a side of the pressure member 20. The other end 32*s*2 is an end of a corresponding inclined slit 32*s* on an opposite side to the pressure member 20 in the first rotational direction R1 of the fixing belt 10. The other end 32*s*2 of each inclined slit 32*s* is located nearer the middle 322 of the heater holding member 32 in the direction of the first rotational axis L1 than a corresponding one end 32*s*1. In other words, the other end 32*s*2 is located nearer the middle 10*c* of the fixing belt 10 in the width direction thereof than the corresponding one end 32*s*1. As described with reference to FIG. 3, the fixing belt 10 rotates in the first rotational direction R1. On the side of the first side surface 320 in FIG. 5, a downstream side in the first rotational direction R1 of the fixing belt 10 corresponds to an upper side in FIGS. 3 and 5. Each of the other ends 32*s*2 of the inclined slits 32*s* corresponding to the upper side extends toward the middle 10*c* of the fixing belt 10.

The two inclined slits 32*s* included in the first confluent slit 321*s* have respective other ends 32*s*2 whose locations differ from each other. Specifically, of the inclined slits 32*s*, the other end 32*s*2 of the inclined slit 32*s* located on the side of the first end 321 is farther from the pressure member 20 than the other end 32*s*2 of the inclined slit 32*s* located on the side of the middle 322.

The two inclined slits 32*s* included in the second confluent slit 322*s* have respective other ends 32*s*2 whose locations differ from each other. Specifically, of the inclined slits 32*s*, the other end 32*s*2 of the inclined slit 32*s* located on the side of the second end 323 is farther from the pressure member 20 than the other end 32*s*2 of the inclined slit 31*s* located on the side of the middle 322.

The inclined slits 32*s* include the first confluent slit 321*s* or the second confluent slit 322*s*. The first and second confluent slits 321*s* and 322*s* are arranged in the width direction of the fixing belt 10 (i.e., rotational axis direction of fixing belt 10) with the middle 322 of the heater holding member 32 interposed between the first and second confluent slits 321*s* and 322*s*. The first and second confluent slits 321*s* and 322*s* meet at the middle 322 of the heater holding member 32.

Figure 6:
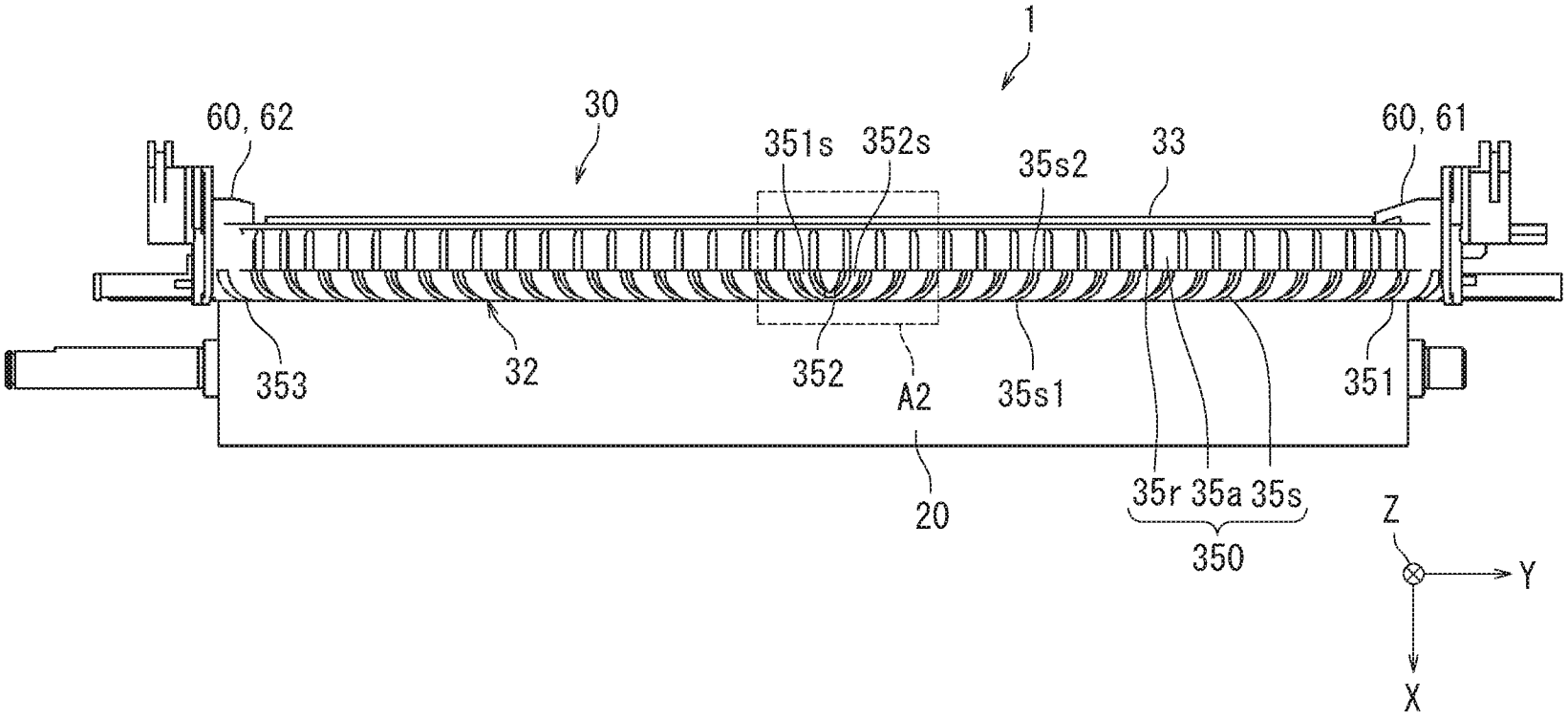
FIG. 6 illustrates the fixing device depicted in FIG. 4, as seen from a negative side of the Z axis.

FIG. 6 is a view of the fixing device 1 depicted in FIG. 4, as seen from the negative side of the Z axis. Specifically, FIG. 6 is a view of the fixing device 1 as seen from the side of the second side surface 350 of the heater holding member 32.

As illustrated in FIG. 6, the second side surface 350 has a first end 351, a middle 352, and a second end 353. Like the first side surface 320, the heater holding member 32 having the main body 35*a* has ribs 35*r* and inclined slits 35*s* on the side of the second side surface 350. Like the ribs 32*r*, the ribs 35*r* are arranged at regular intervals in the rotational axis direction of the fixing belt 10. The ribs 35*r* are not necessarily arranged at regular intervals. The ribs 35*r* protrude from the main body 35*a*. The inclined slits 35*s* are recessed in the main body 35*a*. That is, each of the inclined slits 35*s* is recessed in the main body 35*a*.

The inclined slits 35*s* are arranged at regular intervals in the rotational axis direction of the fixing belt 10. The inclined slits 35*s* are not necessarily arranged at regular intervals. The inclined slits 35*s* are arranged in a symmetrical manner about the middle 352 of the heater holding member 32. Specifically, the inclined slits 35*s* are arranged in a line symmetrical manner about the middle line CL crossing the middle 10*c* of the fixing belt 10 (see FIG. 2).

Inclined slits 35*s* located nearer the first end 351 than the middle 352 may hereinafter be referred to as a "third slit group". In addition, inclined slits 35*s* located nearer the second end 353 than the middle 352 may be referred to as a "fourth slit group".

The heater holding member 32 has inclined slits 32*s*, or third or fourth confluent slit 351*s* or 352*s* on the side of the second side surface 350. The third slit group includes the third confluent slit 351*s*. The fourth slit group includes the fourth confluent slit 352*s*. In the present embodiment, the third confluent slit 351*s* includes two inclined slits 35*s*. In addition, the fourth confluent slit 352*s* includes two inclined slits 35*s*.

The inclined slit 35*s* has one end 35*s*1 and the other end 35*s*2. That is, each of the slits 35*s* includes one end 35*s*1 and the other end 35*s*2. The one end 35*s*1 of each slit 35*s* is an end of a corresponding slit 35*s* on the side of the pressure member 20. The other end 35*s*2 of each slit 35*s* is an end of the corresponding slit 35*s* on the opposite side to the pressure member 20. The one end 35*s*1 of each inclined slit 35*s* is located nearer the middle 352 of the heater holding member 35 than the corresponding other end 35*s*2.

In other words, the one end 35*s*1 is located nearer the middle 10*c* of the fixing belt 10 in the width direction thereof than the corresponding other end 35*s*2. As described with reference to FIG. 3, the fixing belt 10 rotates in the first rotational direction R1. On the side of the second side surface 350 in FIG. 6, a downstream side in the first rotational direction R1 of the fixing belt 10 corresponds to a lower side in FIGS. 3 and 6. Each of the one ends 35*s*1 of the inclined slits 35*s* corresponding to the lower side extends toward the middle 10*c* of the fixing belt 10.

The two inclined slits 35*s* included in the third confluent slit 351*s* have respective one ends 35*s*1 whose locations differ from each other. Specifically, of the inclined slit 35*s*, the one end 35*s*1 of the inclined slit 35*s* located on the side of the first end 351 is nearer the pressure member 20 than the one end 35*s*1 of the inclined slit 35*s* located on the side of the middle 352.

The two inclined slits 35*s* included in the fourth confluent slit 352*s* have respective one ends 35*s*1 whose locations differ from each other. Specifically, of the inclined slit 35*s*, the one end 35*s*1 of the inclined slit 35*s* located on the side of the second end 353 is nearer the pressure member 20 than the one end 35*s*1 of the inclined slit 35*s* located on the side of the middle 352.

The third and fourth confluent slits 351*s* and 352*s* are arranged in the width direction of the fixing belt 10 with the middle 352 of the heater holding member 32 interposed therebetween. The third and fourth confluent slits 351*s* and 352*s* meet at the middle 352 of the heater holding member 32.

Figure 7A:
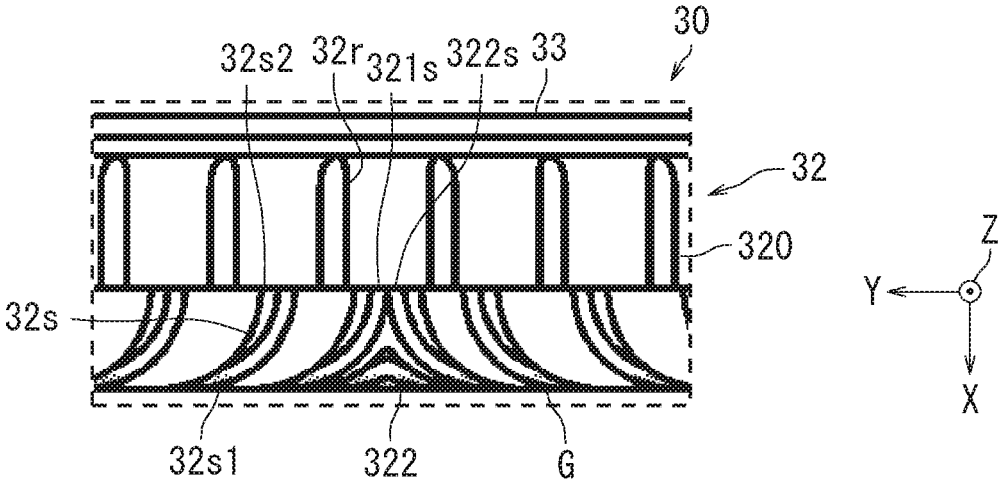
FIGS. 7A to 7C illustrate an A1-part with enlarged scale of FIG. 5.
Figure 7B:
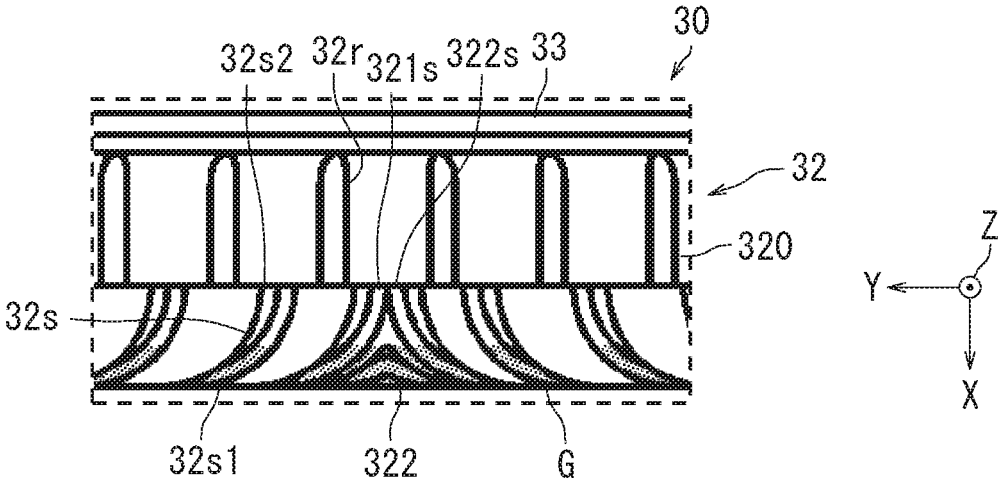
Figure 7C:
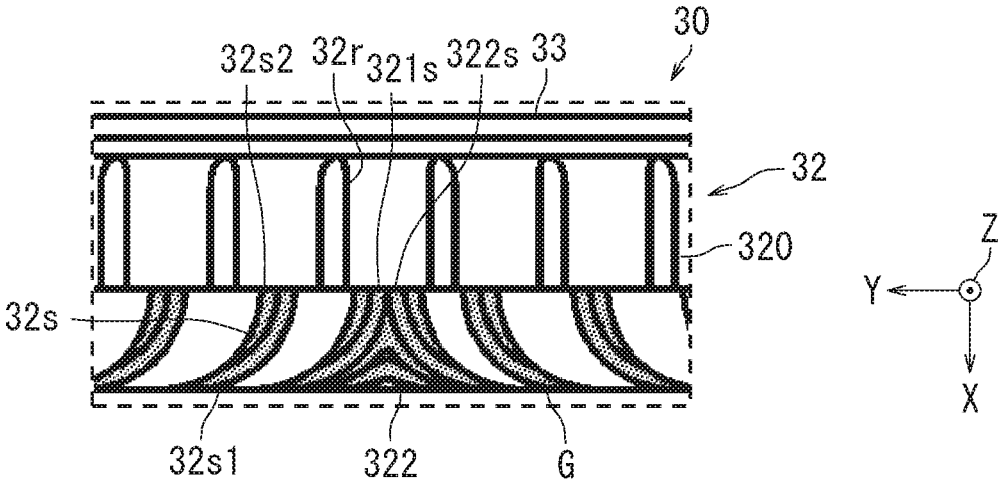

Next, a flow of the lubricating oil G in the present embodiment will further be described with reference to FIGS. 7A to 8C. FIGS. 7A to 7C illustrate an A1-part with enlarged scale of FIG. 5. Specifically, FIGS. 7A to 7C illustrate, in a time-sequence manner, the lubricating oil G on the first side surface 320 when the fixing belt 10 rotates.

FIG. 7A illustrates a state where the fixing belt 10 starts rotating. FIG. 7B illustrates a state where the fixing belt 10 rotates from the state of FIG. 7A. FIG. 7C illustrates a state where the fixing belt 10 still rotates after the state of FIG. 7B. The first rotational direction R1 in each of the states of FIGS. 7A to 7C corresponds to a negative X-axis direction.

When the fixing belt 10 starts rotating in the first rotational direction R1, the lubricating oil G starts moving from the side of the pressure member 20 to the negative side of the X axis as illustrated in FIG. 7A. The inner circumferential surface 104 of the fixing belt 10 is in close contact with the first side surface 320 of the heater holding member 32. The inclined slits 32*s* are recessed in the main body 32*a*. The lubricating oil G accordingly gathers in the inclined slits 32*s* and moves along the inclined slits 32*s*.

When the fixing belt 10 continues rotating, the lubricating oil G adheres to the inclined slits 32*s* from the negative side of the X axis and moves along the inclined slits 32*s* as illustrated in FIG. 7B. The other end 32*s*2 of each of the inclined slits 32*s* is located nearer the middle 322 than the one end 32*s*1 of a corresponding slit 32*s*. The lubricating oil G therefore moves toward the middle 322 from the sides of the first and second ends 321 and 323 of the first side surface 320 along the inclined slits 32*s*.

When the fixing belt 10 still continues rotating, the lubricating oil G reaches respective other ends 32*s*2 of the inclined slits 32*s* as illustrated in FIG. 7C. The lubricating oil G having reached the respective other ends 32*s*2 overflows from the respective other ends 32*s*2 of the inclined slits 32*s*. A junction of the first and second confluent slits 321*s* and 322*s* allows the lubricating oil G to stay there and easily overflow therefrom.

The lubricating oil G moves toward the middle 322 from the sides of the first and second ends 321 and 323 of the heater holding member 32 in an area where the inner circumferential surface 104 of the fixing belt 10 is in contact with the first side surface 320 of the heater holding member 32. As a result, the lubricating oil G reaches the junction of the first and second confluent slits 321*s* and 322*s* and overflows from the inclined slits 32*s*. The lubricating oil G having overflowed adheres to the inner circumferential surface 104 of the fixing belt 10.

When the fixing belt 10 rotates, the lubricating oil G flows toward the ends of the fixing belt 10 in an area where the fixing belt 10 is out of contact with the first side surface 320.

In an area where the fixing belt 10 is in contact with the first side surface 320, the lubricating oil G is conveyed along the inclined slits 32*s* toward the middle 322 of the heater holding member 32 (the middle 10*c* of the fixing belt 10) and then adheres to an area on the side of the middle 10*c* of the fixing belt 10. The lubricating oil G is then conveyed in the rotational direction of the fixing belt 10. The above configuration therefore enables the lubricating oil G to circulate along the inner circumferential surface 104 of the fixing belt 10.

Figure 8A:
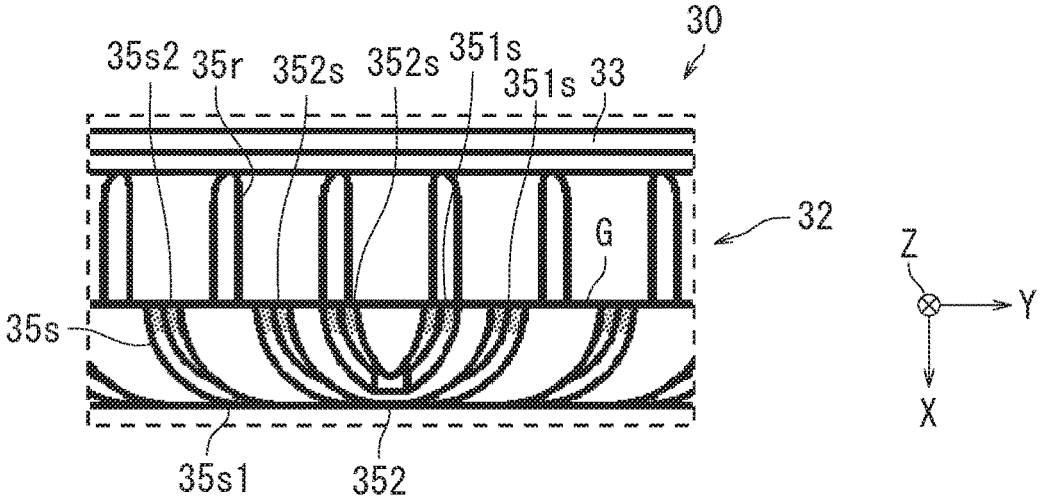
FIGS. 8A to 8C illustrate an A2-part with enlarged scale of FIG. 6.
Figure 8B:
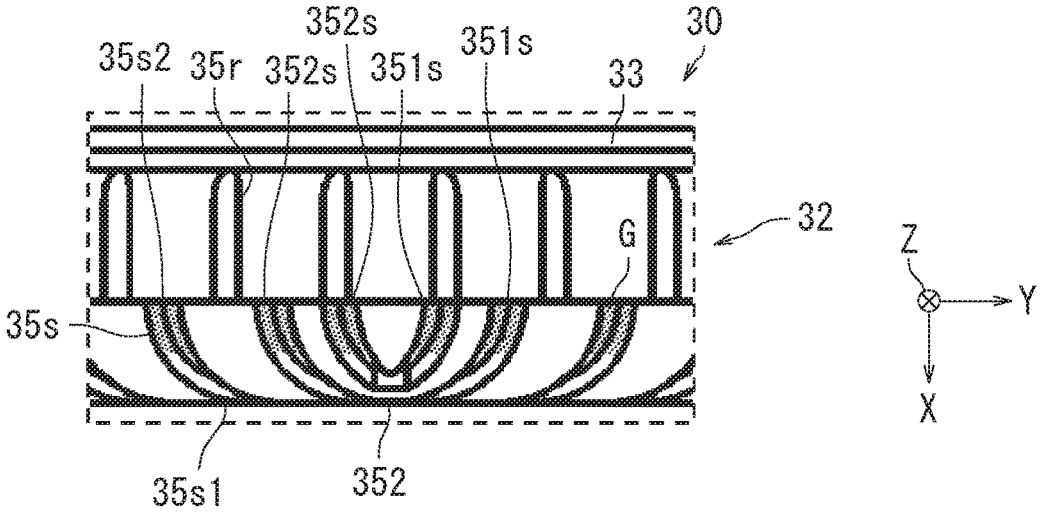
Figure 8C:
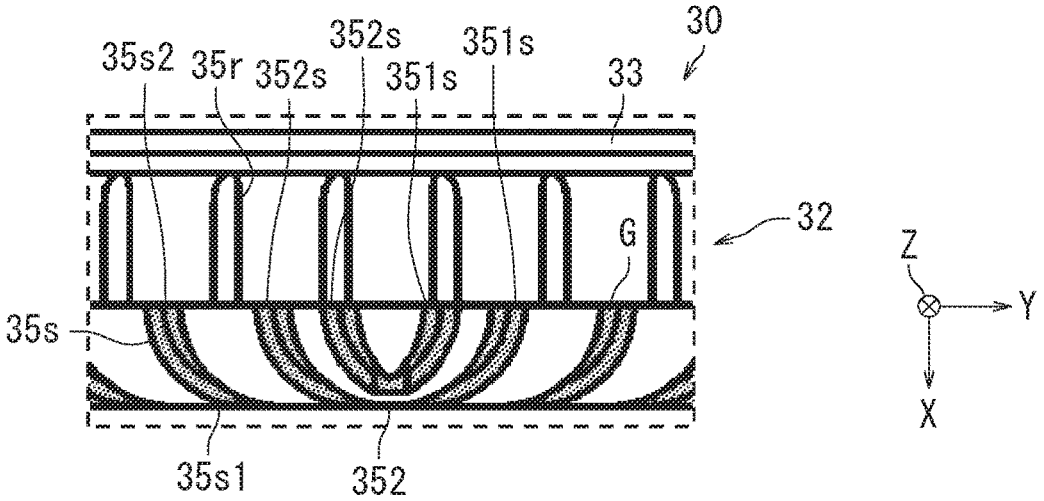

FIGS. 8A to 8C illustrate an A2-part with enlarged scale of FIG. 6. FIG. 8A illustrates a state where the fixing belt 10 starts rotating. FIG. 8B illustrates a state where the fixing belt 10 rotates from the state of FIG. 8A. FIG. 8C illustrates a state where the fixing belt 10 still rotates after the state of FIG. 8B. The first rotational direction R1 in each of the states of FIGS. 8A to 8C corresponds to a positive X-axis direction.

When the fixing belt 10 starts rotating in the first rotational direction R1, the lubricating oil G starts moving from the side of the pressure member 20 to the positive side of the X axis as illustrated in FIG. 8A. The inner circumferential surface 104 of the fixing belt 10 is in close contact with the second side surface 350 of the heater holding member 32. In addition, the inclined slits 35*s* are recessed in the main body 32*a*. The lubricating oil G therefore gathers in the inclined slits 35*s* and moves along the inclined slits 35*s*.

When the fixing belt 10 continues rotating, the lubricating oil G adheres to the inclined slits 35*s* from the positive side of the X axis and moves along the inclined slits 35*s* as illustrated in FIG. 8B. The one end 35*s*1 of each of the inclined slits 35*s* is located nearer the middle 352 than the other end 35*s*2 of a corresponding slit 35*s*. The lubricating oil G accordingly moves toward the middle 352 from the sides of the first and second ends 351 and 353 of the second side surface 350 along the slits 35*s*.

When the fixing belt 10 still continues rotating, the lubricating oil G reaches the respective one ends 35*s*1 of the inclined slits 35*s* as illustrated in FIG. 8C. The lubricating oil G having reached the respective one ends 35*s*1 overflows from the one ends 35*s*1 of the inclined slits 35*s*. A junction of the third and fourth confluent slits 351*s* and 352*s* allows the lubricating oil G to stay there and easily overflow therefrom.

The lubricating oil G moves toward the middle 322 from the sides of the first and second ends 351 and 353 of the heater holding member 32 in an area where the inner circumferential surface 104 of the fixing belt 10 is in contact with the second side surface 350 of the heater holding member 32. The lubricating oil G having overflowed adheres to the inner circumferential surface 104 of the fixing belt 10. As a result, the lubricating oil G reaches the junction of the third and fourth confluent slits 351*s* and 352*s* and overflows from the inclined slits 35*s*.

When the fixing belt 10 rotates, the lubricating oil G flows toward the ends of the fixing belt 10 in an area where the fixing belt 10 is out of contact with the second side surface 350. The lubricating oil G is conveyed along the inclined slits 35*s* toward the middle 352 of the heater holding member 32 (the middle 10*c* of the fixing belt 10) and then adheres to an area on the side of the middle 10*c* of the fixing belt 10. The lubricating oil G is then conveyed in the rotational direction of the fixing belt 10. The above configuration therefore enables the lubricating oil G to circulate along the inner circumferential surface 104 of the fixing belt 10.

Thus, when the fixing belt 10 rotates to be in contact with the first side surface 320, the lubricating oil G moves toward the middle 322 from the sides of the first and second ends 321 and 323 of the first side surface 320. In addition, when the fixing belt 10 rotates to be in contact with the second side surface 350, the lubricating oil G moves toward the middle 352 from the sides of the first and second ends 351 and 353 of the second side surface 350. The lubricating oil G having moved overflows from the inclined slits 32*s* and 35*s* to adhere to an area on the side of the middle 10*c* of the inner circumferential surface 104 of the fixing belt 10. The lubricating oil G is therefore prevented from easily flowing out of the ends of the fixing belt 10 even when the fixing belt 10 rotates.

The inclined slits 32*s* are arranged in a symmetrical manner about the middle 322 of the first side surface 320. In addition, the inclined slits 35*s* are arranged in a symmetrical manner about the middle 352 of the second side surface 350. The lubricating oil G therefore adheres to the inner circumferential surface 104 of the fixing belt 10 without being biased toward one end of the heater holding member 32.

The present embodiment enables less outflow of the lubricating oil G from the fixing device 1.

The configuration according to the present embodiment enables less outflow of the lubricating oil G from the first and second ends 321 and 323 of the heater holding member 32.

In the present embodiment, when the fixing belt 10 rotates in the first rotational direction R1, the lubricating oil G moves toward the first end 101 or the second end 102 while part of the fixing belt 10 is at the nip part between the fixing belt 10 and the pressure member 20. While part of the fixing belt 10 passes through the nip part between the fixing belt 10 and the pressure member 20 to be in contact with the inclined slits 35*s* located on the side of the first end 101 or the side of the second end 102, the lubricating oil G moves toward the center 101*c*. Thus, the fixing device 1 enables preferable circulation of the lubricating oil G on the inner circumferential surface 104 of the fixing belt 10 while the fixing belt 10 is rotating.

In the present embodiment, the inclined slits 35*s* are arranged in a symmetrical manner about the middle 352 of the heater holding member 32. This enables the fixing device 1 to further preferably circulate the lubricating oil G along the inner circumferential surface 104 of the fixing belt 10.

In the present embodiment, the first confluent slit 321*s*, the second confluent slit 322*s*, the third confluent slit 351*s*, or the fourth confluent slit 352*s* is formed. Accordingly, the lubricating oil G collected though the first confluent slit 321*s*, the second confluent slit 322*s*, the third confluent slit 351*s*, or the fourth confluent slit 352*s* can be circulated again along the inner circumferential surface 104 of the fixing belt 10 while the fixing belt 10 is rotating in the first rotational direction R1.

The configuration according to the present embodiment enables re-circulation of the lubricating oil G along the inner circumferential surface 104 of the fixing belt 10 having passed through the heater holding member 32.

Second Embodiment

Figure 9:
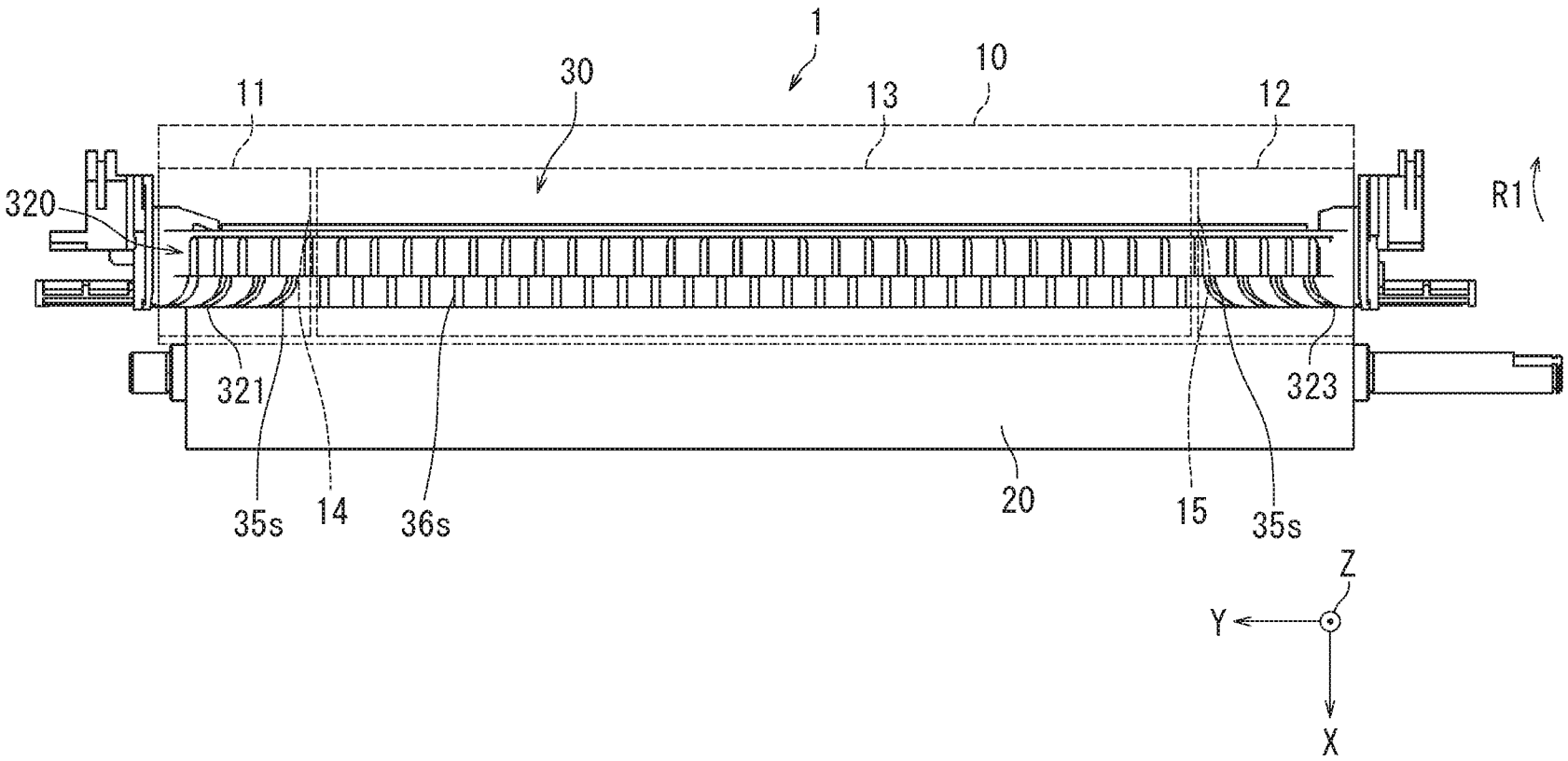
FIG. 9 illustrates a fixing device, as seen from the positive side of the Z axis, of an image forming apparatus according to a second embodiment.

An image forming apparatus 100 according to a second embodiment will next be described with reference to FIG. 9 in addition to FIGS. 1 to 8C. FIG. 9 illustrates a fixing device 1, as seen from the positive side of the Z axis, of the image forming apparatus 100 according to the second embodiment.

In the second embodiment, inclined slits 35*s* are arranged in a first side surface 320 of a heater holding member 32 equipped for the fixing device 1 of the image forming apparatus 100. The inclined slits 35*s* are arranged in an end area (end area 11, end area 12) from an end (first end 321, first end 351, second end 353) to an intermediate part of the heater holding member 32 in a direction of a first rotational axis L1. Here, the intermediate part is from the end to a middle 10*c* of the heater holding member 32 in the direction of the first rotational axis L1.

As illustrated in FIG. 9, the fixing device 1 has the end area 11 and the end area 12. The end area 11 is an area to a boundary line 14 from the first end 321 of the heater holding member 32 equipped for the fixing device 1. Here, the boundary line 14 is between the first end 321 and the middle 10*c*. The end area 12 is an area to a boundary line 15 from the second end 323 of the heater holding member 32 equipped for the fixing device 1. Here, the boundary line 15 is between the second end 323 and the middle 10*c*.

A second side surface 350 of the heater holding member 32 equipped for the fixing device 1 of the image forming apparatus 100 has a configuration similar to that of the first side surface 320. An inclined slit 35*s* is located in an end area 11 of the second side surface 350.

More than one inclined slit 35*s* may be located in the end area 11 of the second side surface 350. Each inclined slit 35*s* may be the same as each inclined slit 35*s* described in the first embodiment.

An inclined slit 35*s* is formed in an end area 12 of the second side surface 350. More than one inclined slit 35*s* may be formed in the end area 12. Each inclined slit 35*s* may be the same as each inclined slit 35*s* described in the first embodiment.

In the present embodiment, the inclined slits 35*s* are located in each of the end area 11 of the first side surface 320 and the end area 12 of the second side surface 350, which the heater holding member 32 has. This enables suppression of outflow of lubricating oil G from the first end 321, the second end 323, the first end 351, and the second end 353 of the heater holding member 32.

In the present embodiment, it is possible to prevent a concentration of the lubricating oil G at the middle 10*c* of an inner circumferential surface 104 of the fixing belt 10 and to achieve uniform distribution of the lubricating oil G.

In the second embodiment, a non-inclined slit 36*s* is located in a middle area 13 other than the end areas 11 and 12.

The non-inclined slit 36*s* is almost parallel to a first rotational direction R1 of the fixing belt 10 or not inclined relative to the direction of the first rotational axis L1 of the fixing belt 10. More than one non-inclined slit 36*s* may be arranged in the middle area 13.

In the present embodiment, it is possible to prevent a concentration of the lubricating oil G at the middle 10*c* of the inner circumferential surface 104 of the fixing belt 10 and to achieve uniform distribution of the lubricating oil G.

Third Embodiment

Figure 10:
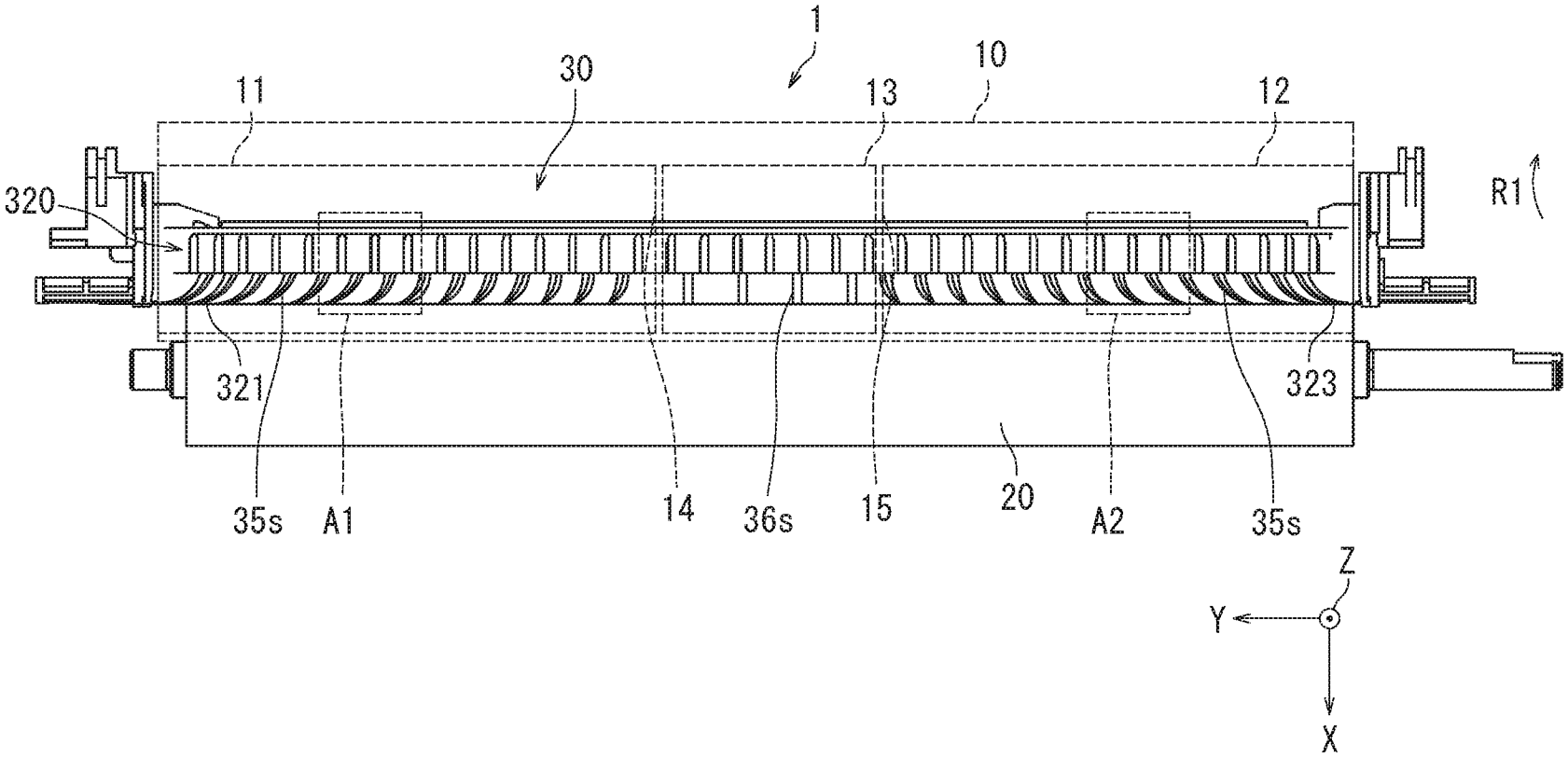
FIG. 10 illustrates a fixing device, as seen from the positive side of the Z axis, of an image forming apparatus according to a third embodiment.
Figure 11A:
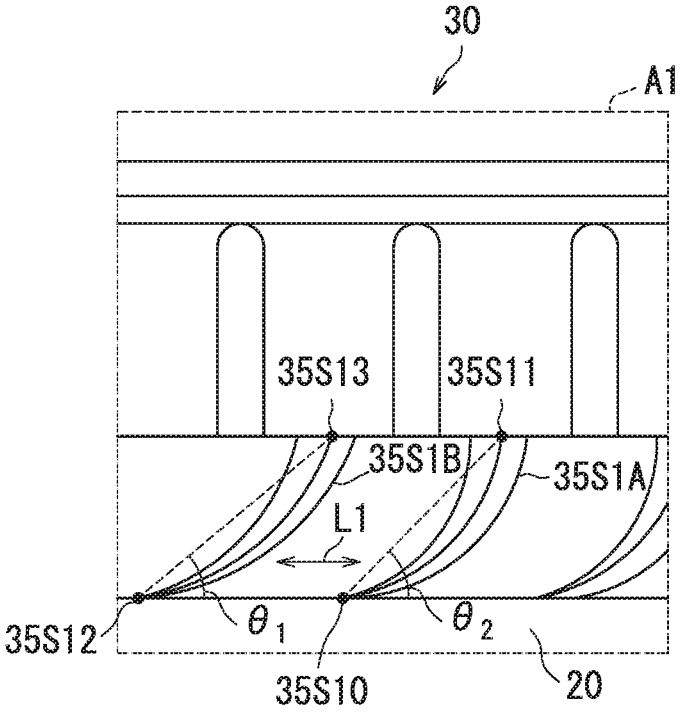
FIGS. 11A and 11B illustrate an A1-part and an A2-part with enlarged scale of FIG. 10, respectively.
Figure 11B:
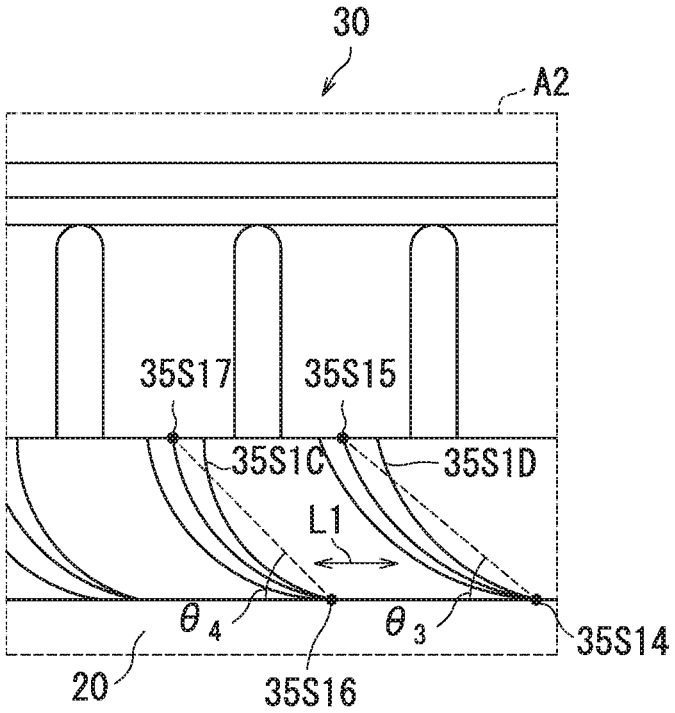

An image forming apparatus 100 according to a third embodiment will next be described with reference to FIGS. 10, 11A, an 11B in addition to FIGS. 1 to 8C. FIG. 10 illustrates a fixing device 1, as seen from the positive side of the Z axis, of the image forming apparatus 100 according to the third embodiment. FIGS. 11A and 11B illustrate an A1-part and an A2-part with enlarged scale of FIG. 10, respectively.

In the fixing device 1 of the image forming apparatus 100 according to the third embodiment, respective inclination angles θ of inclined slits 35*s*, from an end (first end 321, first end 351, second end 323, second end 353) toward a middle 10*c* of the heater holding member 32 in a direction of a first rotational axis L1, relative to the first rotational axis L1 gradually increase.

As illustrated in FIG. 10, the fixing device 1 has an end area 11 and an end area 12. The end area 11 is an area to a boundary line 14 reaching the middle 10*c* of the fixing belt 10 (middle 322 of heater holding member 32) from the first end 321 on a side of a first side surface 320 of the heater holding member 32. The end area 12 is an area to a boundary line 15 reaching the middle 10*c* (middle 322) from the second end 323 on the side of the first side surface 320. Here, the middle area 13 depicted in FIG. 9 need not be provided. That is, the end area 11 and the end area 12 may adjoin each other.

In the end area 11 of the first side surface 320, respective inclination angles θ of inclined slits 35*s*, toward the middle 10*c* of the fixing belt 10 (middle 322) from the first end 321 of the heater holding member 32 in the direction of the first rotational axis L1, relative to the first rotational axis L1 gradually increase.

That is, as illustrated in FIG. 11A, an angle θ2 of an inclined slit 35*s* 1A relative to the direction of the first rotational axis L1 is larger than an angle θ1 of an inclined slit 35*s*1B relative to the direction of the first rotational axis L1.

Specifically, the angle θ2 of a line segment relative to the direction of the first rotational axis L1 is larger than the angle θ1 of a line segment relative to the direction of the first rotational axis L1. Here, the former line segment is a line segment connecting one end 35*s*10 of the inclined slit 35*s*1A on a side of a pressure member 20 and the other end 35*s*11 of the inclined slit 35*s*1A on an opposite side to the pressure member 20. The latter line segment is a line segment connecting one end 35*s*12 of the inclined slit 35*s*1B on the side of the pressure member 20 and the other end 35*s*13 of the inclined slit 35*s*1B on the opposite side to the pressure member 20.

As illustrated in FIG. 11B, an angle θ4 of an inclined slit 35*s*1C relative to the direction of the first rotational axis L1 is larger than an angle θ3 of an inclined slit 35*s*1D relative to the direction of the first rotational axis L1.

Specifically, the angle θ4 of a line segment relative to the direction of the first rotational axis L1 is larger than the angle θ3 of a line segment relative to the direction of the first rotational axis L1. Here, the former line segment is a line segment connecting one end 35*s*16 of the inclined slit 35*s*1C on the side of the pressure member 20 and the other end 35*s*17 of the inclined slit 35*s*1C on the opposite side to the pressure member 20. The latter line segment is a line segment connecting one end 35*s*14 of the inclined slit 35*s*1D on the side of the pressure member 20 and the other end 35*s*15 of the inclined slit 35*s*1D on the opposite side to the pressure member 20.

In the end area 12 of the first side surface 320, respective inclination angles θ of inclined slits 35*s*, toward the middle 10*c* of the fixing belt 10 (middle 322) from the second end 323 of the heater holding member 32 in the direction of the first rotational axis L1, relative to the first rotational axis L1 gradually increase.

The second side surface 350 of the heater holding member 32 equipped for the fixing device 1 of the image forming apparatus 100 has a similar configuration to that of the first side surface 320.

The fixing device 1 has an end area 11 and an end area 12. The end area 11 is an area to a boundary line 14 reaching the middle 10*c* of the fixing belt 10 (middle 322) from the first end 351 of the heater holding member 32 on the side of the second side surface 350. The end area 12 is an area to a boundary line 15 reaching the middle 10*c* (middle 322) from the second end 353 of the heater holding member 32 on the side of the second side surface 350.

The inclined slit 35*s* is located in the end area 11 of the second side surface 350. More than one inclined slit 35*s* may be arranged in the end area 11. Each inclined slit 35*s* may be the same as each inclined slit 35*s* described in the second embodiment.

Respective inclination angles θ of inclined slits 35*s*, toward the middle 10*c* of the fixing belt 10 (middle 322) from the first end 351 of the heater holding member 32 in the direction of the first rotational axis L1, relative to the first rotational axis L1 gradually increase.

The inclined slit 35*s* is located in the end area 12 of the second side surface 350. More than one inclined slit 35*s* may be arranged in the end area 12. Each inclined slit 35*s* may be the same as each inclined slit 35*s* described in the second embodiment.

Respective inclination angles θ of incline slits 35*s*, toward the middle 10*c* of the fixing belt 10 (middle 322) from the first end 351 of the heater holding member 32 in the direction of the first rotational axis L1, relative to the first rotational axis L1 gradually increase.

In the present embodiment, it is possible to prevent the lubricating oil G collected though the inclined slits 35*s* from being excessively resupplied to the middle 10*c* of the fixing belt 10 and to achieve uniform distribution of the lubricating oil G in the fixing belt 10.

In the fixing device 1 of the image forming apparatus 100 according to the third embodiment, at least two non-inclined slits 36*s* are arranged with the middle 10*c* in the direction of the first rotational axis L1 interposed therebetween.

The fixing device 1 has the end area 11 and the end area 12. The end area 11 is an area to the boundary line 14 reaching the middle 10*c* of the fixing belt 10 (middle 322) from the first end 321 of the heater holding member 32, equipped for the fixing device 1, on the side of the first side surface 320. The end area 12 is an area to the boundary line 15 reaching the middle 10*c* (middle 322) from the second end 323 of the heater holding member 32, equipped for the fixing device 1, on the side of the first side surface 320. As described with reference to FIG. 9, the middle area 13 is interposed between the end area 11 and the end area 12.

In the end area 11 of the first side surface 320, the respective inclination angles θ of the inclined slits 35*s*, toward the middle 10*c* of the fixing belt 10 (middle 322) from the first end 321 of the heater holding member 32 in the direction of the first rotational axis L1, relative to the first rotational axis L1 gradually increase.

In the end area 12 of the first side surface 320, the respective inclination angles θ of the inclined slits 35*s*, toward the middle 10*c* of the fixing belt 10 (middle 322) from the second end 323 of the heater holding member 32 in the direction of the first rotational axis L1, relative to the first rotational axis L1 gradually increase.

In the middle area 13 of the first side surface 320, at least two non-inclined slits 36*s* are arranged with the middle 10*c* in the direction of the first rotational axis L1 interposed therebetween. Three or more non-inclined slits 36*s* may be arranged with the middle 10*c* in the direction of the first rotational axis L1 interposed therebetween.

The second side surface 350 of the heater holding member 32 equipped for the fixing device 1 of the image forming apparatus 100 has a similar configuration to that of the first side surface 320.

The fixing device 1 has the end area 11 and the end area 12. The end area 11 is an area to the boundary line 14 reaching the middle 10*c* of the fixing belt 10 (middle 322) from the first end 351 of the heater holding member 32, equipped for the fixing device 1, on the side of the second side surface 350. The end area 12 is an area to the boundary line 15 reaching the middle 10*c* of the fixing belt 10 (middle 322) from the second end 353 of the heater holding member 32, equipped for the fixing device 1, on the side of the second side surface 350.

The inclined slit 35*s* is located in the end area 11 of the second side surface 350. More than one inclined slit 35*s* may be arranged in the end area 12. Each inclined slit 35*s* may be the same as each inclined slit 35*s* described in the second embodiment 2.

The respective inclination angels θ of the inclined slits 35*s*, toward the middle 10*c* of the fixing belt 10 (middle 322) from the first end 351 of the heater holding member 32 in the direction of the first rotational axis L1, relative to the first rotational axis L1 gradually increase.

The inclined slit 35*s* is located in the end area 12 of the second side surface 350. More than one inclined slit 35*s* may be arranged in the end area 12. Each inclined slit 35*s* is the same as each inclined slit 35*s* described in the second embodiment.

The respective inclination angles θ of the inclined slits 35*s*, toward the middle 10*c* of the fixing belt 10 (middle 322) from the first end 351 of the heater holding member 32 in the direction of the first rotational axis L1, relative to the first rotational axis L1 gradually increase.

At least two non-inclined slits 36*s* are arranged in the middle area 13 of the second side surface 350 with the middle 10*c* in the direction of the first rotational axis L1 interposed therebetween. Three or more non-inclined slits 36*s* may be arranged with the middle 10*c* in the direction of the first rotational axis L1 interposed therebetween.

In the present embodiment, it is possible to prevent the lubricating oil G having retrieved though the inclined slits 35*s* from being excessively resupplied to the middle 10*c* of the fixing belt 10 and to achieve uniform distribution of the lubricating oil G in the fixing belt 10.

As above, the embodiments of the present disclosure have been described with reference to the drawings. However, the present disclosure is not limited to the above-described embodiment and can be practiced in various ways within the scope without departing from the essence of the present disclosure (see (1) and (2) below). The drawings mainly illustrate schematic constituent elements in order to facilitate understanding of the disclosure, and properties such as thickness, length, numbers or the like of constituent elements illustrated in the drawings may differ from actual properties thereof in order to facilitate preparation of the drawings. Further, the material, shape, dimensions, and the like of each constituent element described in the above embodiment are merely examples that do not impose any particular limitations and may be altered in various ways as long as such alterations do not substantially deviate from the effects of the present disclosure.

(1) Although the image forming apparatus 100 according to the embodiments of the present disclosure is a monochrome multifunction peripheral as described with reference to FIGS. 1 to 11, the present disclosure is not limited to this. For example, the image forming apparatus 100 may be a monochrome printer. Alternatively, the image forming apparatus 100 may be a color multifunction peripheral or a color printer.

(2) Although slits are provided in each of the main bodies 32*a* and 35*a* on the respective sides of the first and second side surfaces 320 and 350 in the embodiments of the present disclosure, the present disclosure is not limited to this. For example, slits may be provided in only one of main bodies 32*a* and 35*a* on the sides of the first side surface 320 and the side of the second side surface 350.

What is claimed is:

1. A fixing device comprising:

a fixing belt;

a pressure member configured to rotate the fixing belt while applying pressure to an outer circumferential surface of the fixing belt to form a fixing nip between the fixing belt and the pressure member; and a heating section that faces an inner circumferential surface of the fixing belt, wherein the heating section includes a heater configured to heat the fixing belt, and a heater holding member that holds the heater, the heater holding member has a first side surface and a second side surface, the first and second side surfaces facing the inner circumferential surface of the fixing belt, at least one of the first and second side surfaces having a plurality of inclined slits arranged in a direction of a rotational axis of the fixing belt, the inclined slits inclining in the direction of the rotational axis of the fixing belt relative to a rotational direction of the fixing belt, the inclined slits each have one end on a side of the fixing nip and an other end located opposite to the side of the fixing nip, the other end is located nearer a middle of the fixing belt in the direction of the rotational axis than the one end, and the plurality of inclined slits includes two inclined slits between which the middle of the fixing belt in the direction of the rotational axis is interposed, either respective one ends or respective other ends of the two inclined slits meeting at the middle.

2. The fixing device according to claim 1, wherein the inclined slits are arranged in a symmetrical manner about the middle of the fixing belt in the direction of the rotational axis.

3. The fixing device according to claim 1, wherein each of the first and second side surfaces has the plurality of inclined slits.

4. An image forming apparatus comprising the fixing device according to claim 1, and an image forming section configured to form a toner image on a recording medium, wherein the fixing device fixes the toner image to the recording medium.

* * * * *